United States Patent [19]

Hillis

[11] Patent Number: 4,830,376

[45] Date of Patent: May 16, 1989

[54] PUZZLES COMPRISED OF ELEMENTS EACH HAVING A UNIQUE ARRANGEMENT OF MATCHABLE FEATURES

[76] Inventor: W. Daniel Hillis, 135 St. Paul St., Cambridge, Mass. 02146

[21] Appl. No.: 142,047

[22] Filed: Jan. 7, 1988

[51] Int. Cl.[4] ..... A63F 9/12

[52] U.S. Cl. ..... 273/157 R; 273/294

[58] Field of Search ..... 273/156, 157 R, 293, 273/294

[56] References Cited

U.S. PATENT DOCUMENTS

| | | | |
|---|---|---|---|
| 1,997,501 | 4/1935 | Sweney | 273/157 R |
| 2,232,046 | 2/1941 | Bigman | 273/293 |
| 4,361,328 | 11/1982 | Stein et al. | 273/156 |
| 4,381,865 | 5/1983 | De Cubas et al. | 273/294 |

FOREIGN PATENT DOCUMENTS

| | | | |
|---|---|---|---|
| 2346555 | 3/1975 | Fed. Rep. of Germany | 273/157 R |

*Primary Examiner*—Anton O. Oechsle

*Attorney, Agent, or Firm*—Pennie & Edmonds

[57] ABSTRACT

A two dimensional puzzle is disclosed comprising thirty-six four sided tiles. Each of the tiles includes some means for indicating its orientation; and all but one of the tiles further comprises a part of at least one means for matching the tile to other tiles. The matching means illustratively is an interlocking connector having a male and female element one of which elements is disposed in a side of a first tile and the other of which is disposed in a side of a second tile to which the first tile is connected. Each of the four side surfaces of each tile has either a male connector element, a female connector element or neither element; and each tile has a different combination of these three features on its four sides. The puzzle is to arrange the thirty-six tiles in their correct orientation in a six-by-six rectilinear array so that the tiles interlock. Extensions of the puzzle to other dimensions are also disclosed, in particular, a three-dimensional puzzle of 216 blocks that can be assembled in a six-by-six-by-six array of interlocking blocks.

13 Claims, 5 Drawing Sheets

PUZZLES COMPRISED OF ELEMENTS EACH HAVING A UNIQUE ARRANGEMENT OF MATCHABLE FEATURES

SUMMARY OF THE INVENTION

I have devised a two dimension puzzle comprising thirty-six, four-sided tiles. Each of the tiles includes some means for indicating its orientation; and all but one of the tiles further comprises a part of at least one means for matching the tile to other tiles. The matching means illustratively is an interlocking connector having a male and female element one of which elements is disposed in a side of a first tile and the other of which is disposed in a side of a second tile to which the first tile is matched. Each of the four sides of each tile has either a male connector element, a female connector element or neither element; and each tile has a different combination or arrangemetn of these three features on its four sides. The puzzle is to arrange the thirty-six tiles in their correct orientation in a six-by-six rectilinear array so that the tiles interlock.

The puzzle may be extended to other dimensions, in particular, to a three-dimensional puzzle of 216 blocks that can be assembled in a six-by-six-by-six array of interlocking blocks.

BRIEF DESCRIPTION OF THE DRAWINGS

These and other objects, features and advantages of the invention will more readily apparent from the following detailed description of a preferred embodiment of the invention in which.

DETAILED DESCRIPTION OF THE INVENTION

Figure 1:
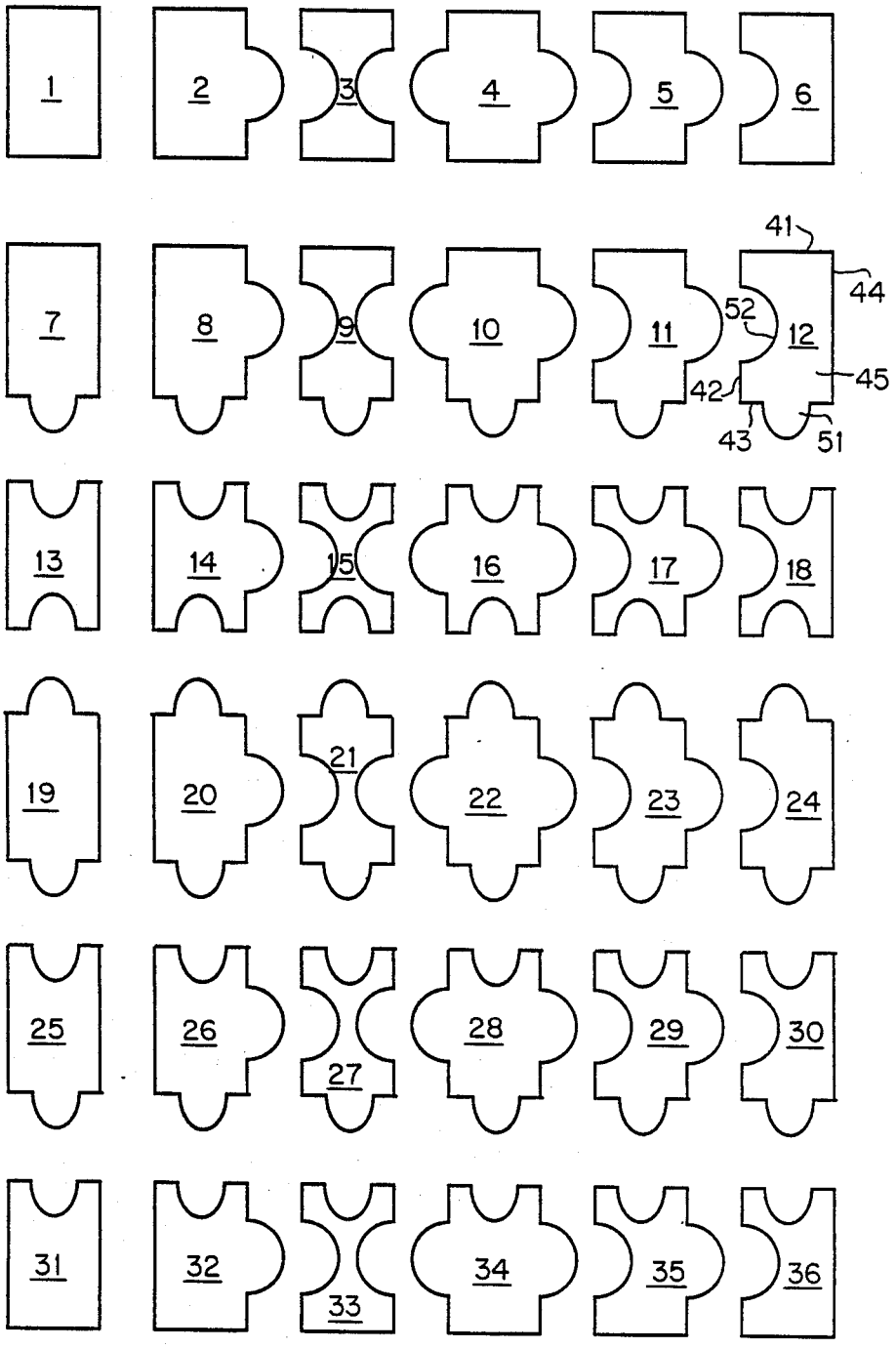
FIG. 1 is a top view of a puzzle of the present invention showing all thirty-six tiles.

FIG. 1 illustrates a top view of a puzzle constructed according to the invention comprising thirty-six interlocking tiles numbered 1 through 36. The object of the puzzle is to fit the thirty-six tiles together into a six-by-six rectilinear array; and as will be apparent the arrangement of tiles shown in FIG. 1 is one solution to the puzzle.

Figure 2:
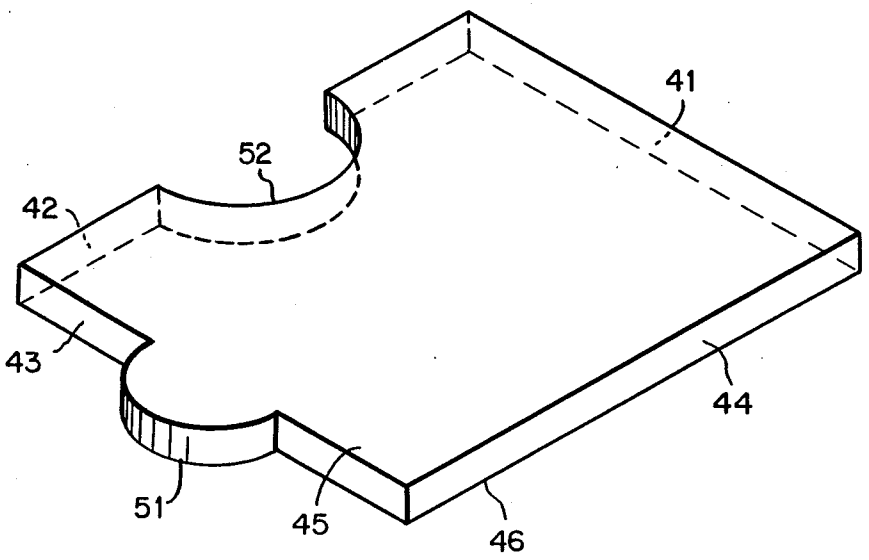
FIG. 2 is a perspective view of one of the tiles of the puzzle.

In FIG. 2, a perspective view is shown of one of these tiles, illustratively tile 12 of FIG. 1. Like all the other tiles, tile 12 is a parallelepiped with four side surfaces 41, 42, 43, 44 and two major surfaces 45 and 46, a first two of said side surfaces 41 and 43 being parallel to one another on opposite sides of said parallelepiped and a second two of said side surfaces 42 and 44 being parallel to one another on opposite sides of said parallelepiped at an angle to side surfaces 41 and 43, with each of two major surfaces 45 and 46 on opposite sides of said parallelepiped and parallel to one another.

All but one of the tiles (tile 1 of FIG. 1) also includes a part of at least one means for matching the tile to another tile. Each such means illustratively is an interlocking connector having a male and a female connecting element, one of which elements is disposed in a side surface of one tile and the other of which is disposed in a side surface of a second tile to which it is matched. Illustratively these male and female connector elements can be pegs and holes or, as shown in FIGS. 1 and 2, protuberances 51 and recesses 52. Alternatively, the elements of the matching means can be designs or characters painted or otherwise affixed to the tiles.

In addition, each of the tiles comprises some means for indicating the orientation of the tile in the plane of the tile. This can be done by making each tile longer in one direction in the plane than the other or by shaping the connecting elements in one direction differently from those in the other direction. Direction may also be indicated by other visual devices such as the grain or texture of the material from which the tile is made.

Since each tile can have either a male connecting element, a female connecting element or no connecting element in each of its four side surfaces, there are $3\times3\times3\times3=81$ possible combinations of these three features on the four sides of a set of tiles. However, several of these combinations are redundant if we allow for the possibilities of reorienting tiles by rotation; and it can be shown that there are only the thirty-six unique tiles shown in FIG. 1 with one of these three features one each of its four side surfaces.

I have found that this set of thirty-six tiles provide an interesting puzzle in assembling them into a six-by-six rectilinear array. Because of the number of pieces and the constraints imposed by the use of interlocking male and female elements on tiles that have to be oriented in a specific direction, it is quite difficult to assemble the tiles into such an array by trial-and-error processes. Additional requirements that the outside edges of the array be straight (or rectilinear) and that tile surfaces that have no connecting element (i.e. are straight) can adjoin only other tile surfaces that are straight further limit the number of possible solutions to a very few indeed. At the same time, logical analysis of the puzzle will reveal a simple plan for solving the puzzle which will be left for the reader to deduce.

The puzzle may also be implemented in structures of other dimensions. A one-dimensional version of the puzzle is illustrated in the left-hand column of FIG. 1. A three-dimensional version can be constructed in 216 parallelepipeds, each having four side surfaces wherein opposite sides are parallel as in the case of the two-dimensional version shown in FIG. 1 and two remaining surfaces that are parallel to one another on opposite sides of the parallelepiped.

Figure 3:
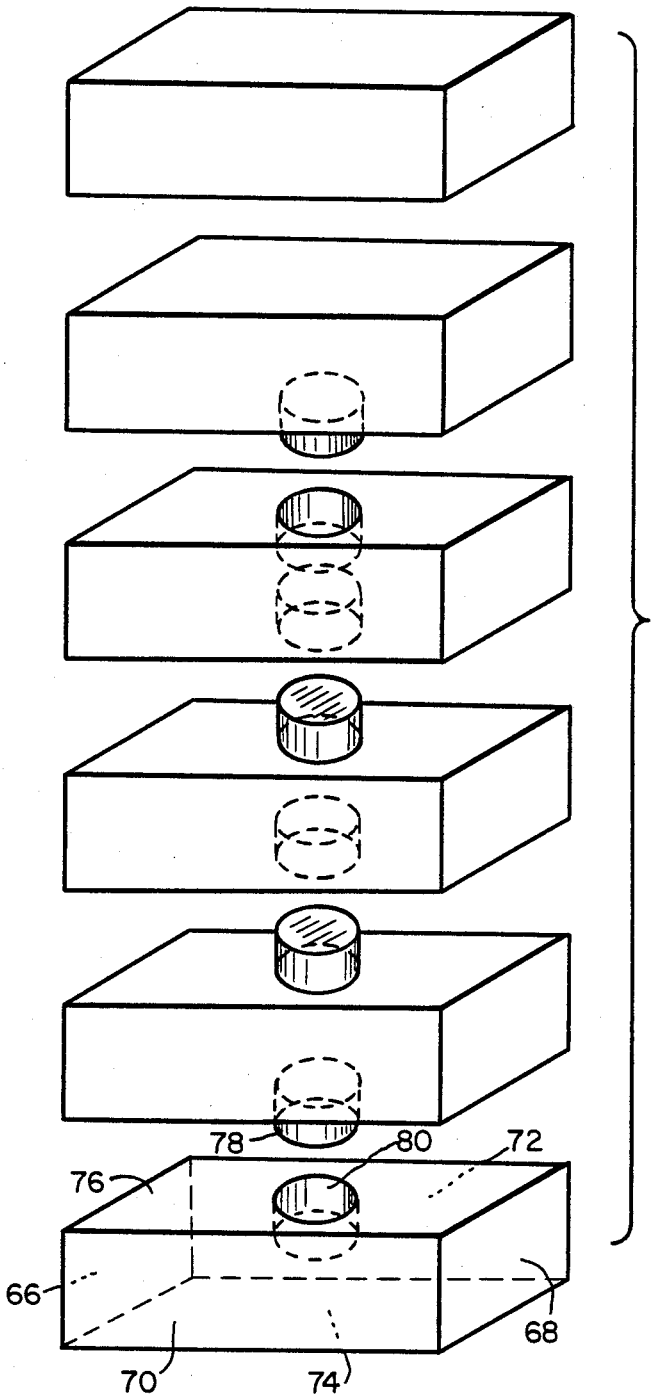
FIG. 3 is a perspective view of a column of blocks useful in understanding an embodiment of the invention using two hundred sixteen blocks.

FIG. 3 illustrates a perspective view of six of the 216 blocks constructed according to the invention. These blocks are numbered 54, 56, 58, 60, 62 and 64. Like all of the other 216 blocks, each block is a parallelepiped having six surfaces, a first two of said side surfaces 66 and 68 being parallel to one another on opposite sides of said parallelepiped, a second two of said side surfaces 70 and 72 being parallel to one another on opposite sides of said parallelepiped and at an angle to side surfaces 66 and 68, and each of two major surfaces 74 and 76 being parallel to one another on opposite sides of said parallelepiped.

In this three-dimensional version, all but one of the 216 blocks includes a part of at lest one means for matching the block to another block. Each such means illustratively is an interlocking connector having a male and female connecting element, one of which elements is disposed in a surface of one block and the other of which is disposed in a surface of a second block to which it is connected. As shown in FIG. 3, these male and female connector elements can be protuberances 78 and recesses 80.

In addition, each of the blocks comprises some means for indicating its orientation. This can be done by making the height, width and depth of each block different or by shaping the connecting elements in the vertical, horizontal and normal directions differently or by use of appropriate combinations of these six qualities. Direction may also be indicated by other devices such as the grain or texture of the material from which the block is made.

Since each block can have either a male connecting element, a female connecting element or no connecting element in each of its six surfaces, there are $3\times3\times3\times3\times3\times3=729$ possible combinations of these features on the six sides of a set of blocks. Elimination of the redundancies encountered upon reorienting blocks by rotation yields 216 unique blocks with one of these three features on each of its six side surfaces.

As will be apparent to those skilled in the art numerous variations may be mde in the practice of the invention. In particular, all manner of techniques may be used to match tiles or blocks together and indicate their orientation, only some of which have been indicated above. In general, the puzzle assigns one of three values to each side or surface of a tile and requires the tiles to be assembled in accordance with two rules:

1. the side of a tile having that value which corresponds to the absence of a matching element must be placed adjacent that same value on the next tile; and 2. the side of a tile having either of the two remaining values which correspond to the male and female elements must be placed adjacent the other of these two values on the next tile.

Figure 4:
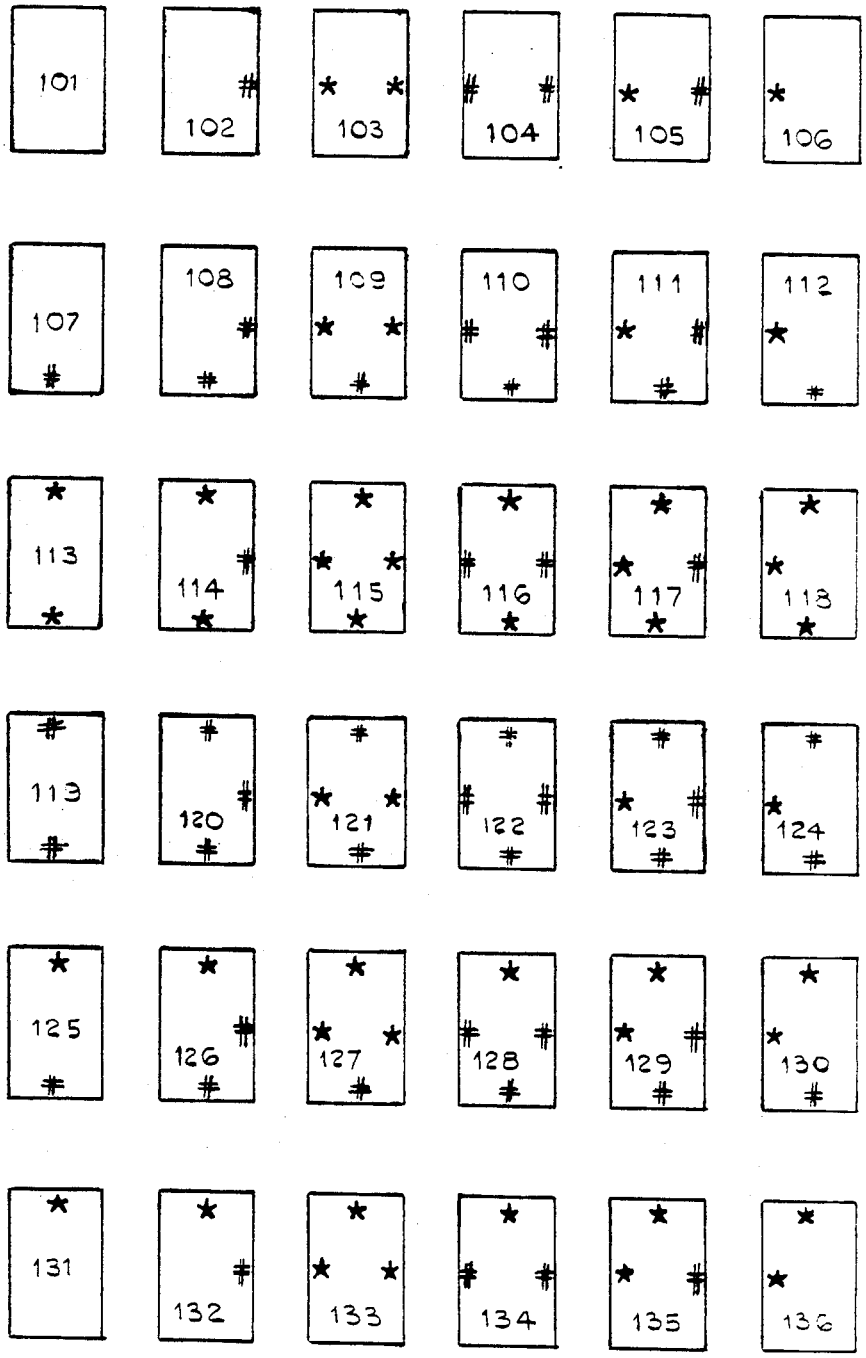
FIG. 4 is a top view of a generic representation of the puzzle of the present invention.

This generic rule is illustrated in FIG. 4 which depicts a six-by-six array of tiles numbered 101 through 136. Each of the four sides of each tile has one of three values, two of which are represented in FIG. 4 by the symbols "#" and "*", which represent generically two designs, two characters, male and female elements or the like, and the third of which is represented by the absence of any design, character, symbol or shape.

Figure 5:
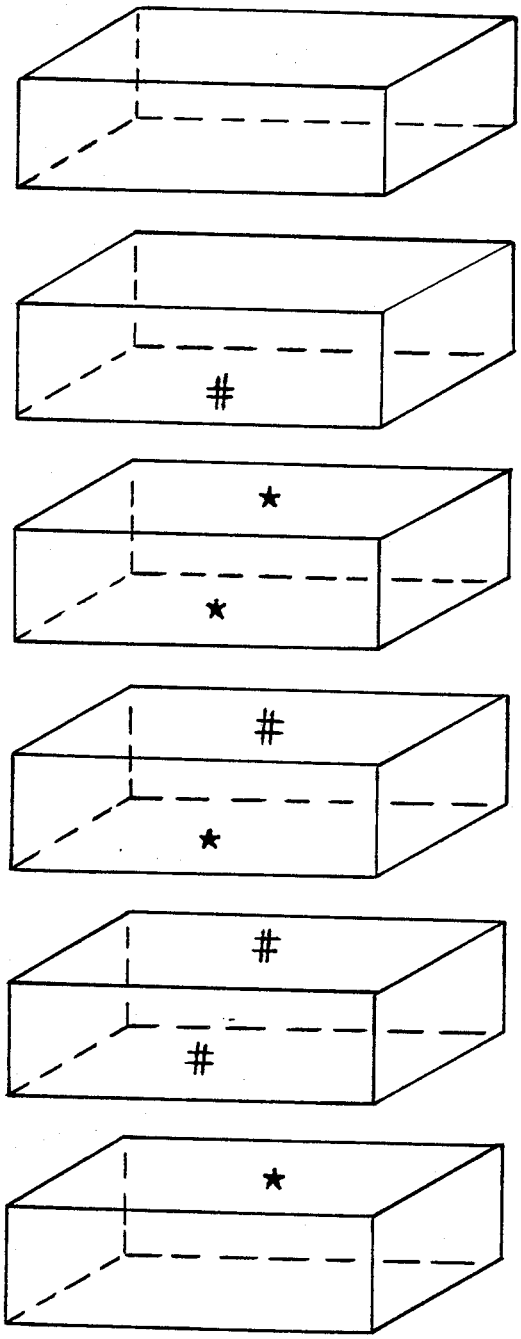
FIG. 5 is a perspective view of a column of blocks depicting a portion of a generic representation of an embodiment of the invention using two hundred sixteen blocks.

In like fashion, this generic rule may also be applied in structures of other dimensions; and FIG. 5 illustrates the application of this generic rule to one column of six blocks of a six-by-six-by-six array constructed according to the invention.

What is claimed is:

1. A puzzle comprising thirty-six tiles, each tile having four sides, means for establishing a direction of each tile in a plane defined by one of its major surfaces, means for matching the tiles to one another comprising first and second matching element in some of the sides of said tiles, each side having only one first matching element, second matching element or neither matching element and each tile having a different arrangement of first matching element, second matching element and neither matching element on its four sides, whereby the thirty-six tiles can be arranged in a six-by-six array of matched tiles in which interior sides of tiles having neither first nor second matching element are placed adjacent one another and sides having first matching elements are placed adjacent sides having second matching elements.

2. The puzzle of claim 1 wherein two of the sides of each said tile are parallel to one another on opposite sides of said tile and a second two of said sides are parallel to one another on opposite sides of said tile and at an angle to said first two of said sides.

3. The puzzle of claim 1 wherein the first and second matching elements are pegs and holes and the tiles are fitted together so they interlock.

4. The puzzle of claim 1 wherein the first and second matching elements are designs.

5. A puzzle comprising thirty-six tiles, each tile having four side surfaces, a first two of said side surfaces being parallel to one another on opposite sides of said tile and a second two of said side surfaces being parallel to one another on opposite sides of said tile and at an angle to said first two of said side surfaces, means for establishing a direction of each tile in a plane through the tiles, and means for matching the tiles to one another comprising male and female elements in the side surfaces of said tiles, each side surface having only one male element, one female element, or neither male nor female element and each tile having a different arrangement of male elements, female elements and neither male nor female elements, whereby the thirty-six tiles can be arranged in a six-by-six array of matched tiles in which interior side surfaces of tiles having neither male nor female elements are placed adjacent one another and side surfaces having male elements are placed adjacent side surfaces having female elements.

6. A puzzle comprising thirty-six tiles, each tile having four sides, means for establishing a direction of each tile in a plane defined by one of its major surfaces, means for matching the tiles to one another comprising on each side of each tile an element having one of three possible values, each tile having a different arrangement of such values on its four sides, the tiles being fitted together so that tile sides having a first of the three possible values are placed adjacent to one another and tile sides having a second of such values are placed adjacent to tile sides having a third of such values, whereby the thirty-six tiles can be arranged in a six-by-six array of matched tiles.

7. The puzzle of claim 6 wherein the second and third values are pegs and holes and the tiles are fitted together so they interlock.

8. The puzzle of claim 6 wherein the second and third values are designs.

9. The puzzle of claim 6 wherein the second and third values are male and female elements and the first value is a flat side.

10. A puzzle comprising two hundred sixteen blocks each block comprising a parallelepiped having two major surfaces and four side surfaces, a first two of said side surfaces being parallel to one another on opposite sides of said parallelepiped and a second two of said side surfaces being parallel to one another on opposite sides of said parallelepiped and at an angle to said first two of said side surfaces, and said two major surfces being parallel to one another on opposite sides of said parallelepiped, means for establishing an orientation for each parallelepiped in two dimensions, and means for matching the parallelepiped to one another comprising on each surface of each parallelepiped an element having one of three possible values, each parallelepiped having a different arrangement of such values on its six surfaces, the parallelepiped being fitted together so that surfaces the tiles being fitted together so that tile sides having a first of the three possible values are placed adjacent to one another and tile sides having a second of such values are placed adjacent to tile sides having a third of such values, whereby the two hundred sixteen parallelepipeds can be arranged in a six-by-six-by-six array of matched parallelepipeds.

11. The puzzle of claim 10 wherein the second and third values are male and female elements and the first value is a flat side.

12. The puzzle of claim 10 wherein the second and third values are pegs and holes and the tiles are fitted together so they interlock.

13. The puzzle of claim 10 wherein the second and third values are designs.

* * * * *